US010449591B2

(12) United States Patent
Kim et al.

(10) Patent No.: US 10,449,591 B2
(45) Date of Patent: Oct. 22, 2019

(54) SHEET ROLL FORMING METHOD, AND RUNNING CUTTER AND ROUND BENDER APPLIED THERETO

(71) Applicant: SUNGWOO HITECH CO., LTD., Busan (KR)

(72) Inventors: Min Woo Kim, Busan (KR); Bong Kun Son, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 715 days.

(21) Appl. No.: 14/583,930

(22) Filed: Dec. 29, 2014

(65) Prior Publication Data

US 2015/0183017 A1 Jul. 2, 2015

(30) Foreign Application Priority Data

Dec. 30, 2013 (KR) ..... 10-2013-0167836
Dec. 8, 2014 (KR) ..... 10-2014-0175096

(51) Int. Cl.
*B21D 5/08* (2006.01)
*B21D 5/14* (2006.01)
(Continued)

(52) U.S. Cl.
CPC ..... *B21D 35/001* (2013.01); *B21D 5/08* (2013.01); *B21D 5/14* (2013.01); *B21B 2015/0014* (2013.01); *Y10T 83/50* (2015.04)

(58) Field of Classification Search
CPC ..... B21D 11/203; B21D 11/206; B21D 5/06; B21D 5/086; B21D 5/14; B21D 35/001
(Continued)

(56) References Cited

U.S. PATENT DOCUMENTS 3,279,229 A * 10/1966 Lagher ..... B21D 5/14 493/305
5,974,932 A * 11/1999 Suzuki ..... B23D 25/04 83/318
(Continued)

FOREIGN PATENT DOCUMENTS

JP 11-169955 6/1999
JP 11169955 A * 6/1999
(Continued)

OTHER PUBLICATIONS

Machine Translation of JP 11-169955, Printed May 10, 2017, 8 Pages.*
(Continued)

*Primary Examiner* — Gregory D Swiatocha
(74) *Attorney, Agent, or Firm* — Lex IP Meister, PLLC

(57) ABSTRACT

A sheet roll forming method includes an uncoiling step for uncoiling a coil by an uncoiler provided at a start of a process line, a straightening step for straightening the coil from the uncoiler to be a flat panel, a piercing step for forming holes for various purposes in the panel fed from the straightening step by a piercing press, a sheet roll forming step for cutting the panel to be a sheet with a predetermined dimension by a running cutter and for successively bending the cut sheet to be a shaped beam by a multi-stage roll forming unit, and a bending step for curvature forming the shaped beam to be a shaped product by a round bender.

6 Claims, 6 Drawing Sheets

(51) Int. Cl.
*B21B 15/00* (2006.01)
*B21D 35/00* (2006.01)

(58) Field of Classification Search
USPC ..... 72/166, 169, 172, 335–338, 170, 173
See application file for complete search history.

(56) References Cited

U.S. PATENT DOCUMENTS

| | | | | | |
|---|---|---|---|---|---|
| 6,067,834 | A * | 5/2000 | Stone | B21D 1/02 | 72/130 |
| 6,122,814 | A * | 9/2000 | Pennig | B21D 17/02 | 29/412 |
| 6,339,946 | B1 * | 1/2002 | Yamashita | B21C 37/08 | 72/170 |
| 8,336,355 | B2 * | 12/2012 | Koo | B21D 5/086 | 72/168 |
| 2013/0305798 | A1 * | 11/2013 | Lee | B21D 7/08 | 72/31.07 |

FOREIGN PATENT DOCUMENTS

| | | | |
|---|---|---|---|
| KR | 10-1998-0076538 | | 11/1998 |
| KR | 10-2008-0110363 | | 12/2008 |
| KR | 102011006845 | A * | 6/2011 |
| KR | 10-2011-0076444 | | 7/2011 |
| KR | 10-2012-0077092 | | 7/2012 |

OTHER PUBLICATIONS

Machine Translation of KR20110068456, Sohn, Sung Man; Translated Jul. 25, 2018, 4 Pages.*

* cited by examiner

SHEET ROLL FORMING METHOD, AND RUNNING CUTTER AND ROUND BENDER APPLIED THERETO

CROSS-REFERENCE TO RELATED APPLICATION

This application claims priority to and the benefit of Korean Patent Application No. 10-2013-0167836 filed in the Korean Intellectual Property Office on Dec. 30, 2013, and Korean Patent Application No. 10-2014-0175096 filed in the Korean Intellectual Property Office on Dec. 8, 2014, the entire contents of which are incorporated herein by reference.

BACKGROUND OF THE INVENTION

(a) Field of the Invention

The present invention relates to a sheet roll forming method. More particularly, the present invention relates to a sheet roll forming method, and a running cutter and a round bender applied thereto. In the sheet roll forming method, a blanking step for cutting a coil with a predetermined dimension is carried out and then a sheet roll forming step is carried out.

(b) Description of the Related Art

In general, roll forming is a method including uncoiling a coil material and passing it through multi-stages of roll forming units each having one pair of an upper roll and a lower roll disposed on a line for forming a predetermined shape by successive bending. Further, the roll forming method is applicable to fabrication of straight-type formed products formed by bending into predetermined shapes, such as vehicle bumper beams or other members of a certain shape.

FIG. 1 illustrates a schematic view of a related art roll forming system, with steps thereof shown thereon.

Referring to FIG. 1, in the related art roll forming method, an uncoiler 101, provided at a start of a process line for uncoiling a coil C supplied thereto, processes an uncoiling step S101 of feeding the coil. And then a straightener 103 is provided next in a process direction after the uncoiler 101, to process a straightening step S102 for straightening the uncoiled coil C from the uncoiler 101 to be a flat panel P.

A piercing press 105 is provided next in the process direction after the straightener 103, to process a piercing step S103 for forming holes for various purposes in the panel P fed from the straightener 103.

A roll forming unit 107 including a plurality of roll formers (R1 to R7) is disposed next in the process direction of the piercing press 105 to process a roll forming step S104 for successively bending the panel P to be a forming a predetermined straight type of formed beam B.

A round bender 109 is disposed next in the process direction of roll forming unit 107 to process a bending step 105 for bending the straight formed beam B to be a shaped beam B with a curvature.

A cutting press 111 is provided next in the process direction after the round bender 109 to process a cutting step S106 for cutting the shaped beam 20 to produce a formed product with a predetermined dimension.

However, when the formed product has a closed cross section, a cutting portion may be crushed by a cutting edge of the cutting press 111.

Also, if a wheel cutter is used instead of the cutting press 111, dust and noise may deteriorate work environments.

Also, the roll forming step may be needed to be stopped during the cutting step so that productivity may be deteriorated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a sheet roll forming method of which a blanking step for cutting a coil with a predetermined dimension is carried out and then a sheet roll forming step is carried out so as to improve quality of products and work environments.

A sheet forming method according to one or a plurality of exemplary embodiments of the present invention may include an uncoiling step for uncoiling a coil by an uncoiler provided at a start of a process line, a straightening step for straightening the coil from the uncoiler to be a flat panel, a piercing step for forming holes for various purposes in the panel fed from the straightening step by a piercing press, a sheet roll forming step for cutting the panel to be a sheet with a predetermined dimension by a running cutter and for successively bending the cut sheet to be a shaped beam by a multi-stage roll forming unit, and a bending step for curvature forming the shaped beam to be a shaped product by a round bender.

The sheet roll forming step may include a feeding step for supplying the pierced panel to the next step by roll feeders after the piercing step, a blanking step for cutting the panel with a predetermined dimension to be the sheet after the feeding step by the running cutter operating synchronized with feeding speed of the panel, and a formation step for successively bending the sheet to be the shaped beam by the multi-stage roll forming unit after the blanking step.

The shaped product may have a predetermined curvature, a predetermined length and at least one closed section.

The running cutter may include a synchronizing unit including a slide base slidable along a rail disposed on a base provided to the process line, and a synchronizing motor configured on the base for driving a screw shaft connected with the slide base through a screw housing, and a cutting unit including a lower cutting mold disposed on the slide base, an upper cutting mold disposed above the lower cutting mold and a blanking cylinder equipped to the slide base through a frame for driving the upper cutting mold, wherein the running cutter cuts the panel with a predetermined dimension to be the sheet operating synchronized with feeding speed of the panel.

The round bender may include a plurality of upper and lower bending rollers equipped to a frame disposed on a base in the process line along a curve with a predetermined curvature radius, wherein the lower bending rollers which are disposed at the outside of the curve from the curvature radius center have a smaller diameter than the upper bending rollers and two lower bending rollers are disposed corresponding to one upper bending roller.

The round bender may include a driving motor disposed on a side of the base and connected with a foremost lower bending roller to drive the foremost lower bending roller.

The round bender may further include a correction means which is disposed at rear of the last upper and lower bending rollers and corrects curvature variation of the shaped beam.

The correction means may include upper and lower correction rollers rotatably disposed at rear of the last upper and lower bending rollers through a slider, and a servo motor disposed on the frame corresponding to the slider and moving the slider to inside or outside of the curvature radius.

The plurality of upper and lower bending rollers may form at least 5 sets of which each set is comprised of one upper bending roller and two lower bending rollers for supporting three points of the shaped beam respectively.

A running cutter according to one or a plurality of exemplary embodiments of the present invention may include a synchronizing unit including a slide base slidable along a rail disposed on a base provided to the process line, and a synchronizing motor configured on the base for driving a screw shaft connected with the slide base through a screw housing, and a cutting unit including a lower cutting mold disposed on the slide base, an upper cutting mold disposed above the lower cutting mold and a blanking cylinder equipped to the slide base through a frame for driving the upper cutting mold, wherein the running cutter may cut the panel with a predetermined dimension to be the sheet operating synchronized with feeding speed of the panel.

A round bender according to one or a plurality of exemplary embodiments of the present invention may include a plurality of upper and lower bending rollers equipped to a frame disposed on a base in the process line along a curve with a predetermined curvature radius, wherein the lower bending rollers which are disposed at the outside of the curve from the curvature radius center may have a smaller diameter than the upper bending rollers and two lower bending rollers are disposed corresponding to one upper bending roller.

The round bender may include a driving motor disposed on a side of the base and connected with a foremost lower bending roller to drive the foremost lower bending roller.

The round bender may further include a correction means which is disposed at rear of the last upper and lower bending rollers and corrects curvature variation of the shaped beam.

The correction means may include upper and lower correction rollers rotatably disposed at rear of the last upper and lower bending rollers through a slider, and a servo motor disposed on the frame corresponding to the slider and moving the slider to inside or outside of the curvature radius.

The plurality of upper and lower bending rollers may form at least 5 sets of which each set is comprised of one upper bending roller and two lower bending rollers for supporting three points of the shaped beam respectively.

According to various embodiments of the sheet roll forming method, a blanking step for cutting a coil with a predetermined dimension and then a sheet roll forming step is carried out so that a cutting step in post processing may be omitted so as to improve quality of products and work environments.

In the blanking step, since a plate panel, not shaped beam is cut, so that durability of a cutting edge of the running cutter may be improved, and deformation during cutting may be reduced and thus quality of the product may be improved.

Also, a wheel cutting applied in a related art may be omitted, and thus dust and noise may be reduced and work environments may be improved.

DESCRIPTION OF SYMBOLS

Figure 1:
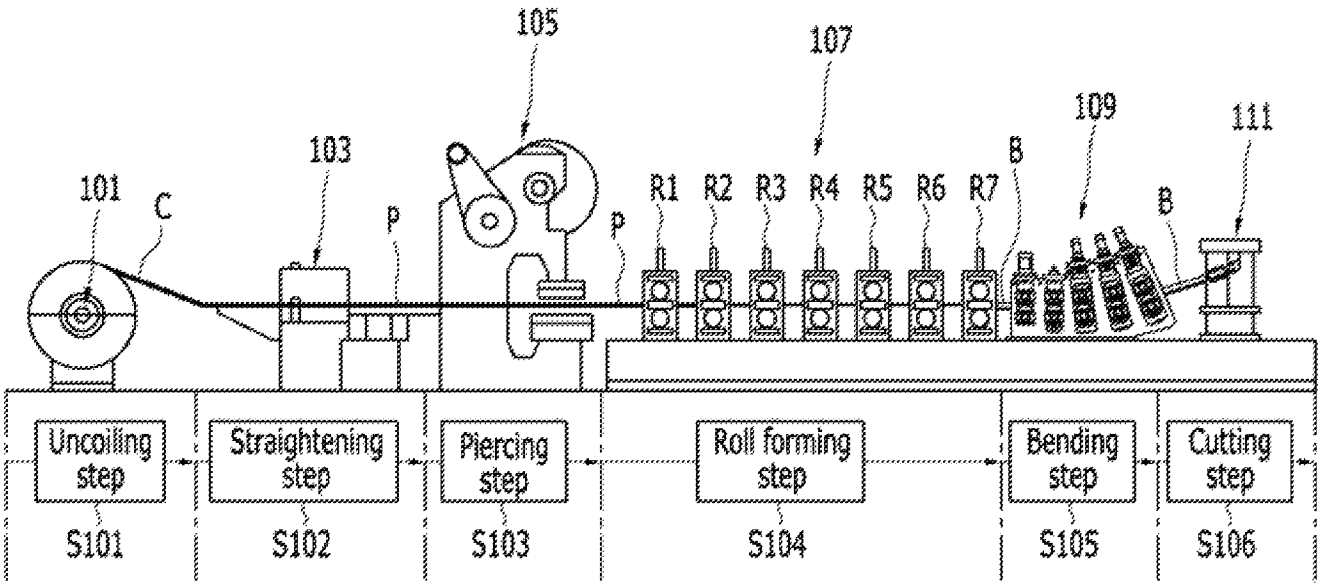
(Prior Art) FIG. 1
FIG. 1 illustrates a schematic view of a related art roll forming system, with steps thereof shown thereon.

1: uncoiler
2: straightener
3: piercing press
41: roll feeder
42: running cutter
43: roll former
6: round bender
10: synchronizing unit
11: base
13: rail
15: slide base
17: synchronizing motor
18: screw housing
19: screw shaft
20: cutting unit
21: lower cutting mold
23: upper cutting mold
25: frame
27: blanking cylinder
C: coil
P: panel
ST: sheet
B: shaped beam
F: shaped product
61: lower bending roller
63: upper bending roller
65: base
67: frame
70: correction means
71: upper correction roller
73: lower correction roller
75: slider
M1: driving motor
M2: servo motor
T: level difference

DETAILED DESCRIPTION OF THE EMBODIMENTS

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
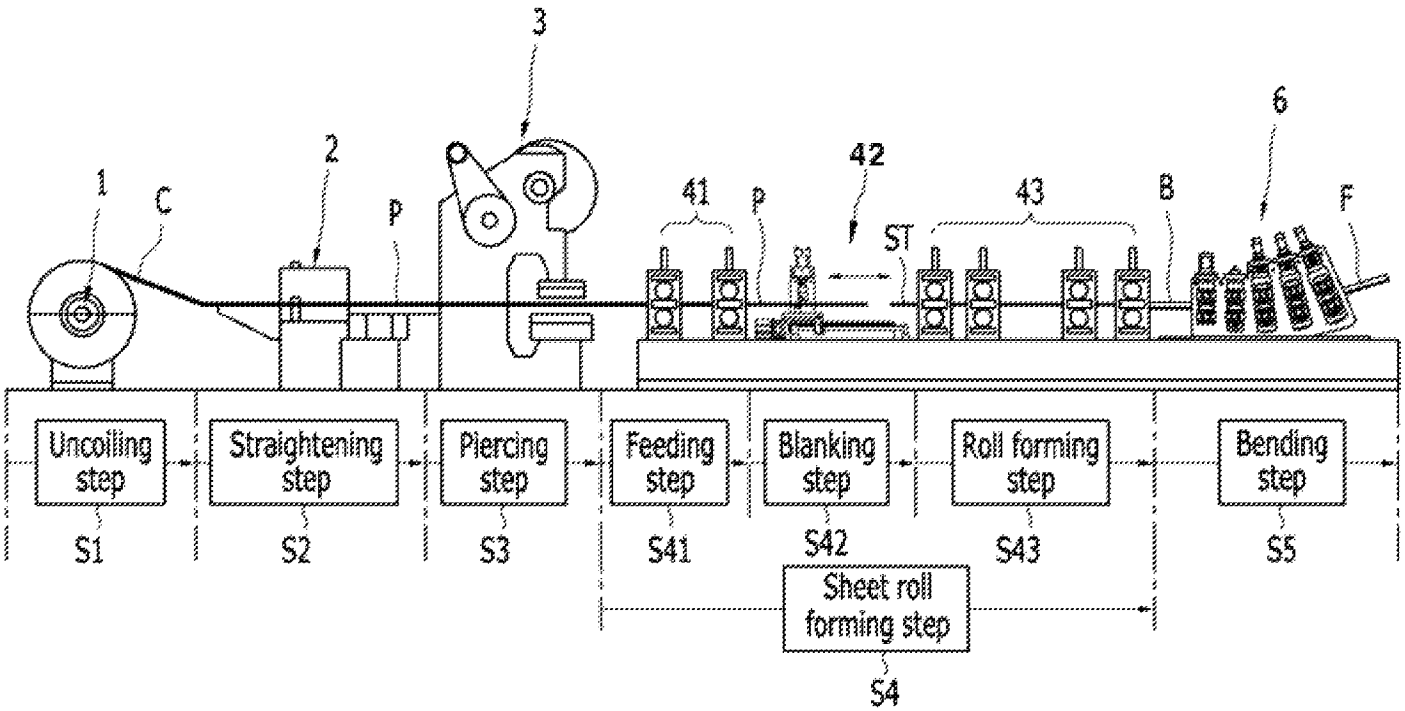
FIG. 2 illustrates a schematic view of a sheet roll forming system and a sheet roll forming method of an exemplary embodiment of the present invention.
Figure 3:
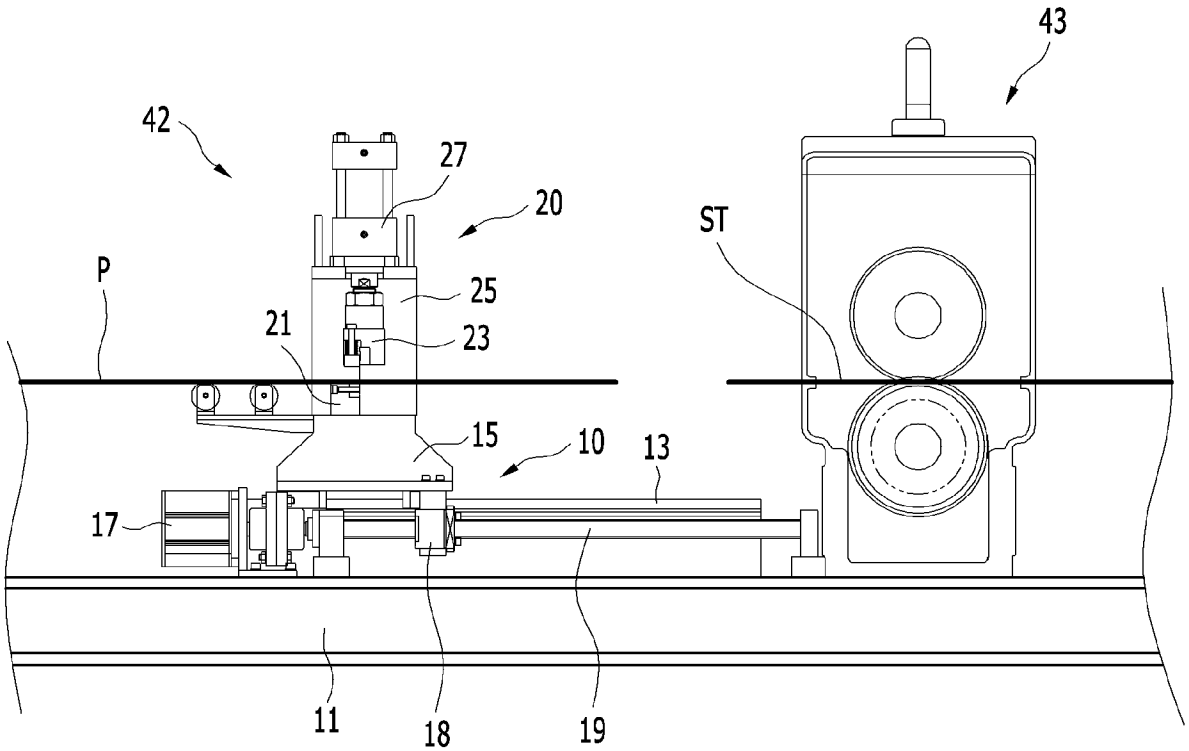
FIG. 3 and FIG. 4 are drawings illustrating a running cutter according to an exemplary embodiment of the present invention.
Figure 4:
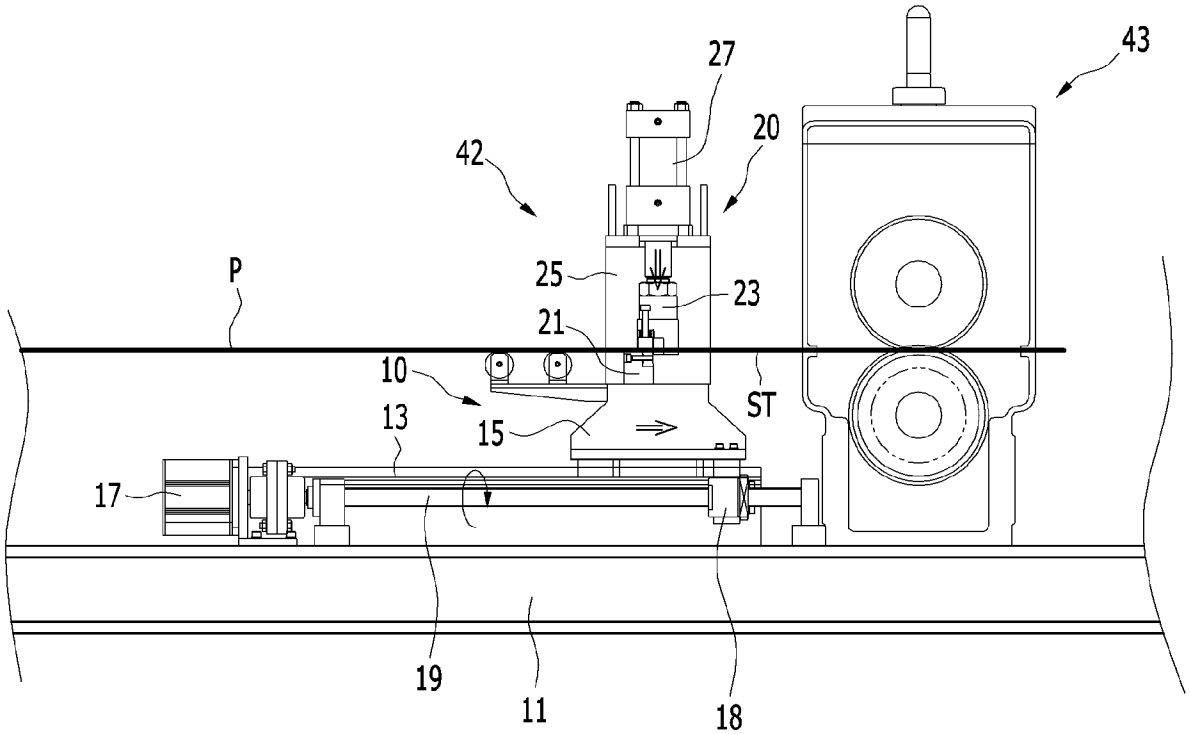

FIG. 2 illustrates a schematic view of a sheet roll forming system and a sheet roll forming method of an exemplary embodiment of the present invention, and FIG. 3 and FIG. 4 are drawings illustrating a running cutter according to an exemplary embodiment of the present invention.

Referring to FIG. 2, a sheet roll forming method according to an exemplary embodiment of the present invention includes an uncoil step S1, a straightening step S2, a piercing step S3, a sheet roll forming step S4, and a bending step S5 sequentially.

In the uncoiling step S1, an uncoiler 1 is provided at a start of a process line to uncoil a coil C.

The coil C fed from the uncoiler 1 is introduced to the straightening step S2.

In the straightening step S2, the coil C is straightened to be a panel P and then fed to the next step.

The straightening step S2 may be carried out by a straightener 2 and so on.

The panel P straightened at the straightening step S2 is introduced to the piercing step S3.

In the piercing step S3, a piercing press 3 forms holes for various purposes in the panel P fed from the straightening step S2.

In the piercing step S3, a brake press and so on may be used instead of the piercing press 3.

The pierced panel P in the piercing step S3 is introduced to the sheet roll forming step S4.

The sheet roll forming step S4 includes a feeding step S41, a blanking step S42 and a roll forming step S43.

In the feeding step S41, a plurality of roll feeders 41 supply the pierced panel P to the next step after the piercing step S3 supporting the pierced panel P.

Schemes of the roll feeder 41 may be similar to a roll former 43.

Referring to FIG. 3, in the blanking step S42, a running cutter 42 cuts the panel P with a predetermined dimension to be a sheet ST after the feeding step S41 operating synchronized with feeding speed of the panel P.

In the roll forming step S43, a multi-stage roll forming unit 43 successively bends the sheet ST to be a shaped beam B.

The running cutter 42 includes a synchronizing unit 10 and a cutting unit 20.

The synchronizing unit 10 includes a slide base 15 slidable along a rail 13 disposed on a base 11 provided to the process line, and a synchronizing motor 17 configured on the base 11.

The synchronizing motor 17 drives a screw shaft 19, and the slide base 15 is connected with the screw shaft 19 through a screw housing 18 engaged with the screw shaft 19. So, the slide base 15 is moved forward or rearward along the rail 11 according to operations of the synchronizing motor 17.

The cutting unit 20 includes a lower cutting mold 21 disposed on the slide base 15, an upper cutting mold 23 disposed above the lower cutting mold 21 and a blanking cylinder 27 equipped to the slide base 15 through a frame 25 for driving the upper cutting mold 23.

An end of an operating rod of the blanking cylinder 27 is connected to the upper cutting mold 23, and the upper cutting mold 23 moves down and up to cut the panel P together with the lower cutting mold 21 according to operations of the blanking cylinder 27.

Referring to FIG. 4, the running cutter 42 cuts the panel P fed from the roll feeders 41 with a predetermined dimension to be the sheet ST operating synchronized with feeding speed of the panel P according to operation of the synchronizing motor 17.

In the exemplary embodiments, the blanking step S42 is conducted using the running cutter 42. However, a blanking press, a laser cutter also may be applied to the blanking step S42 with synchronized moving speed.

In this case, the sheet ST has a length corresponding to a length of a final shaped product F.

The shaped beam B bent in the sheet roll forming step S4 is introduced to the bending step S5.

In the bending step S5, a round bender 6 curvature forms the shaped beam B to be a final shaped product F.

The shaped product F has a predetermined curvature, a predetermined length and at least one closed section.

As described above, according to the sheet roll forming method of various exemplary embodiments of the present invention, since the blanking step S42 is conducted before the roll forming step S43, the sheet ST, cut corresponding to the product size, is roll formed.

Thus, without a cutting process in an after process, the panel P is cut in flat state, so that cutting quality of the final product may be obtained.

Particularly, if the final product has a plurality of a closed section such as a bumper beam, deformation of incision surface may be reduced and size of the final product may be under control without variation in sizes.

In the blanking step S42, since the flat panel P, not the shaped beam B, is cut, so that durability of a cutting edge of the running cutter may be improved, and deformation during cutting may be reduced and thus quality of the product may be improved.

Figure 5:
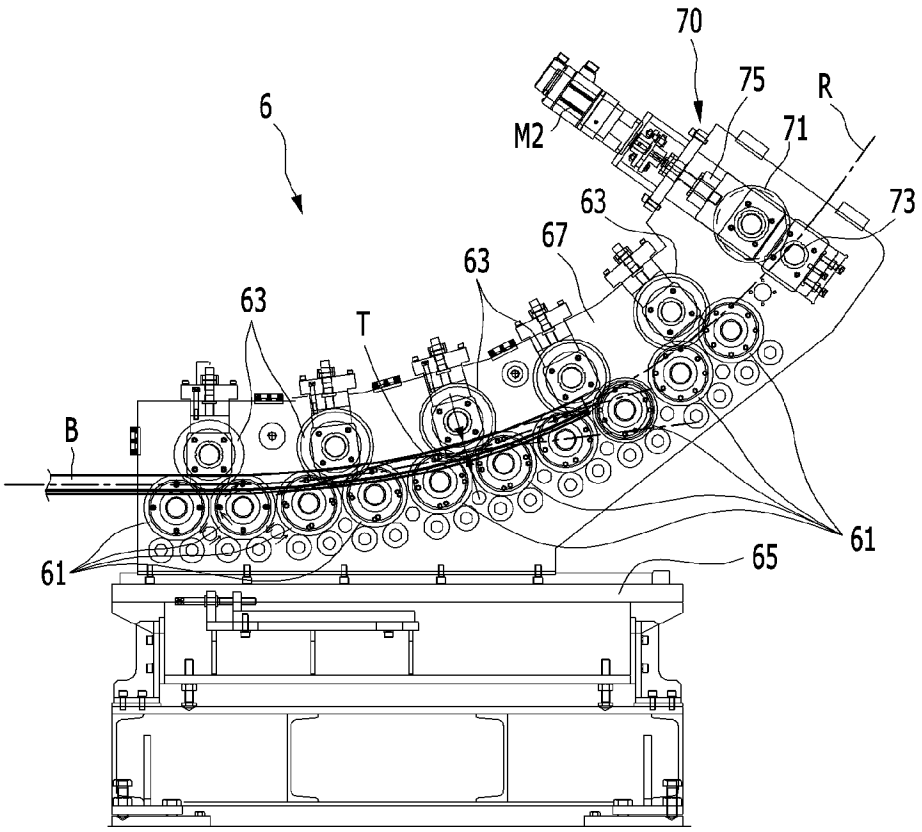
FIG. 5 is a side view illustrating a round bender according to an exemplary embodiment of the present invention.
Figure 6:
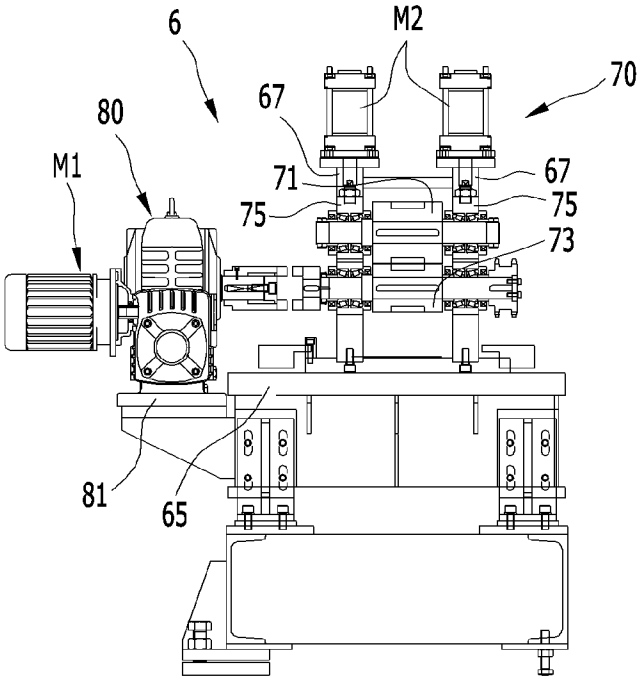
FIG. 6 is a front view illustrating a round bender according to an exemplary embodiment of the present invention.

Referring to FIG. 5 and FIG. 6, the round bender 6 according to an exemplary embodiment of the present invention is disposed on a base 65 next to the roll forming unit 43.

The round bender 6 forms the shaped beam B to be the final shaped product F with a predetermined curvature.

The round bender 6 includes a frame 67 mounted on the base 65 and upper and lower bending rollers 63 and 61 mounted to the frame 67 along a curve R with a curvature radius.

The lower bending rollers 61 which are disposed at the outside of the curve R from the curvature radius center have a smaller diameter than the upper bending rollers 63 and two lower bending rollers 61 are disposed corresponding to one upper bending roller 63. In the drawing, 5 sets (two lower bending rollers 61 and one upper bending roller 63) are disposed. However it is not limited thereto.

Each of two lower bending rollers 63 and one upper bending roller 61 forms one set and supports three points of the shaped beam B respectively and 5 sets of two lower bending rollers 63 and one upper bending roller 61 may be disposed along the curvature radius R on the frame 67.

A driving motor M1 is disposed to a side of the base 65 through a motor bracket 81 and connected with a foremost lower bending roller 61 to drive the foremost lower bending roller 61.

The round bender 6 further includes a correction means 70 which is disposed at rear of the last upper and lower bending rollers 63 and 61 and corrects curvature variation of the shaped beam B using upper and lower correction rollers 71 and 73 according to operations of a servo motor M2.

The upper and lower correction rollers 71 and 73 are rotatably disposed at rear of the last upper and lower bending rollers 63 and 61 through a slider 75 and each upper and lower correction rollers 71 and 73 corrects curvature of the shaped beam B.

The servo motor M2 is disposed on the frame 67 corresponding to the slider 75 and moves the slider 75 to inside or outside of the curvature radius R.

As described above, the lower bending roller 61 of the round bender 6 is reduced in size, and one upper bending roller 63 and two lower bending rollers 61 are combined to support 3-points of the shaped beam B stably and thus distances between adjacent sets of one upper bending roller 63 and two lower bending rollers 61 are reduced and level differences T between adjacent sets of one upper bending roller 63 and two lower bending rollers 61 are reduced too, for example shorter than 10 mm. Thus unpredictable braking, bending or deformation of the shaped beam B may be prevented.

Also, since the round bender 6 is driven using its own driving motor M1, forming stress of the material in curvature forming may be reduced.

Also, the correction means 70 may adjust curvature variation of the shaped beam B using the upper and lower correction roller 71 and 73 operated by the servo motor M2 rear of the last upper and lower bending roller 63 and 61 by moving the slider 75 to inside or outside of the curvature radius R.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A sheet roll forming method comprising:

an uncoiling step for uncoiling a coil by an uncoiler provided at a start of a process line;

a straightening step for straightening the coil from the uncoiler to be a flat panel;

a piercing step for forming holes for various purposes in the panel fed from the straightening step by a piercing press;

a sheet roll forming step for cutting the panel to be a sheet with a predetermined dimension by a running cutter and for successively bending the cut sheet to be a shaped beam by a multi-stage roll forming unit; and a bending step for curvature forming the shaped beam to be a shaped product by a round bender, wherein the round bender comprises a plurality of upper and lower bending rollers equipped to a frame disposed on a base in the process line along a curve with a predetermined curvature radius, wherein the lower bending rollers disposed at an outside of the curve from a curvature radius center have a smaller diameter than the upper bending rollers and two of the lower bending rollers are disposed corresponding to one of the upper bending rollers, wherein the round bender further comprises a correction means which is disposed at a rear of last ones of the upper and lower bending rollers and corrects curvature variation of the shaped beam, wherein the correction means comprises:

an upper correction roller and a lower correction roller rotatably disposed at a rear of the last upper and lower bending rollers through a slider; and a servo motor disposed on the frame corresponding to the slider and moving the slider to inside or outside of the curvature radius, wherein a diameter of the upper correction roller is always larger than a diameter of the lower correction roller at any portion.

2. The sheet roll forming method of claim 1, wherein the sheet roll forming step comprises:

a feeding step for supplying the panel after the piercing step by roll feeders;

a blanking step for cutting the panel to be the sheet with the predetermined dimension after the feeding step by the running cutter operating synchronized with a feeding speed of the panel; and a formation step for successively bending the sheet to be the shaped beam by the multi-stage roll forming unit after the blanking step.

3. The sheet roll forming method of claim 2, wherein the shaped product has a predetermined curvature, a predetermined length and at least one closed section.

4. The sheet roll forming method of claim 2, wherein the running cutter comprises:

a synchronizing unit including a slide base slidable along a rail disposed on a base provided to the process line, and a synchronizing motor configured on the base for driving a screw shaft connected with the slide base through a screw housing; and a cutting unit including a lower cutting mold disposed on the slide base, an upper cutting mold disposed above the lower cutting mold and a blanking cylinder equipped to the slide base through a frame for driving the upper cutting mold, wherein the running cutter cuts the panel with a predetermined dimension to be the sheet operating synchronized with the feeding speed of the panel.

5. The sheet roll forming method of claim 1, wherein the round bender comprises a driving motor disposed on a side of the base and connected with a foremost lower bending roller to drive the foremost lower bending roller.

6. The sheet roll forming method of claim 1, wherein the plurality of upper and lower bending rollers form at least 5 sets of which each set is comprised of one upper bending roller and two lower bending rollers for supporting three points of the shaped beam respectively.

* * * * *